US006149533A

United States Patent [19]

Finn

[11] Patent Number: 6,149,533

[45] Date of Patent: Nov. 21, 2000

[54] GOLF CLUB

[76] Inventor: Charles A. Finn, 2955 Cottingham St., Oceanside, Calif. 92054

[21] Appl. No.: 08/926,557

[22] Filed: Sep. 10, 1997

Related U.S. Application Data

[60] Provisional application No. 60/025,236, Sep. 13, 1996.

[51] Int. Cl.[7] ..... A63B 53/06

[52] U.S. Cl. ..... 473/336; 473/341; 473/245; 473/305

[58] Field of Search ..... 473/334, 335, 473/336, 340, 341, 245, 246, 247, 300, 305, 308, 313

[56] References Cited

U.S. PATENT DOCUMENTS

| | | | |
|---|---|---|---|
| 2,520,702 | 8/1950 | Verderber | 473/245 |
| 5,244,210 | 9/1993 | Au | 473/336 |
| 5,533,725 | 7/1996 | Reynolds, Jr. | 473/307 |
| 5,571,053 | 11/1996 | Lane | 473/336 |
| 5,577,965 | 11/1996 | Burgess | 473/230 |
| 5,603,666 | 2/1997 | Bowe | 473/307 |
| 5,688,189 | 11/1997 | Bland | 473/314 |

*Primary Examiner*—Kien T. Nguyen
*Attorney, Agent, or Firm*—John E. Wagner; Robert C. Smith

[57] ABSTRACT

A golf club includes a head having a striking face, a threaded cylindrical chamber behind and generally parallel to the face, a cylindrical weight member threaded in the chamber, a hosel attached to the cylindrical weight member having a shaft receiving socket with a non-circular portion and a threaded portion, a shaft having a hosel engaging end with a mating non-circular cross section and a ferrule having threads engagable with the threaded portion of the socket. An additional weight is adjustable in the chamber to provide the desired balance characteristics to the club. A second embodiment includes a head which is symmetrical so that the hosel may be attached at either end to make the club ambidextrous. Some different structures for attaching the hosel to the cylindrical weight member provide for variations in the loft of the club. Other embodiments include an asymmetrically weighted movable weight member which engages the head within a cavity therein and is adjustable both longitudinally and by changing the location of its center of gravity. A tool mates with each of the adjustments to provide complete and accurate club assembly and adjustment.

25 Claims, 8 Drawing Sheets

FIG. 1
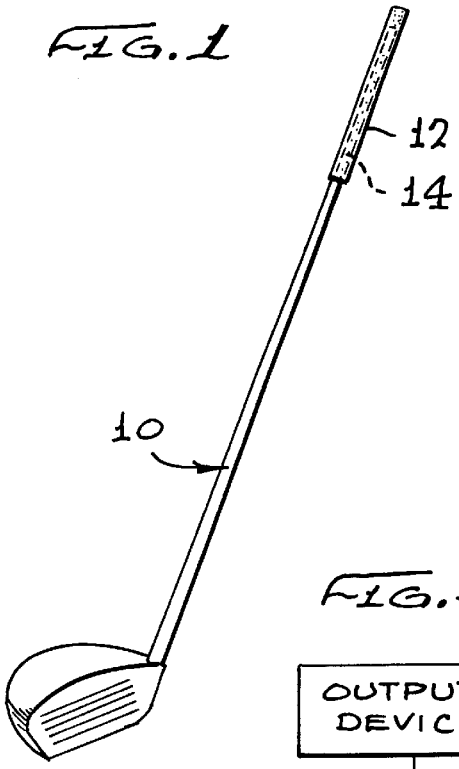
FIG. 2
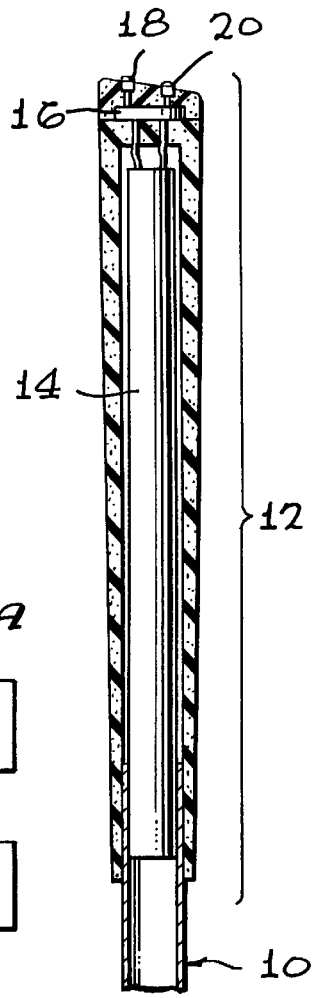
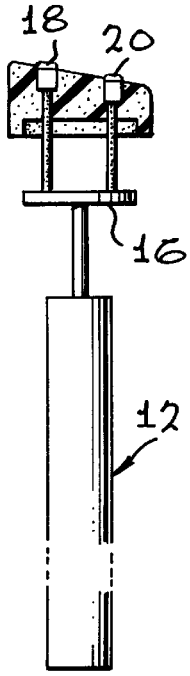
FIG. 3
FIG. 3A
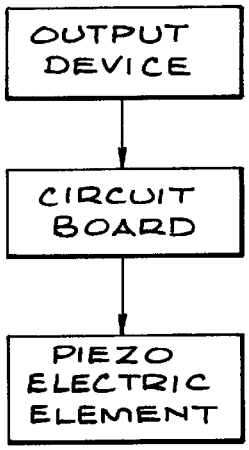
FIG. 4
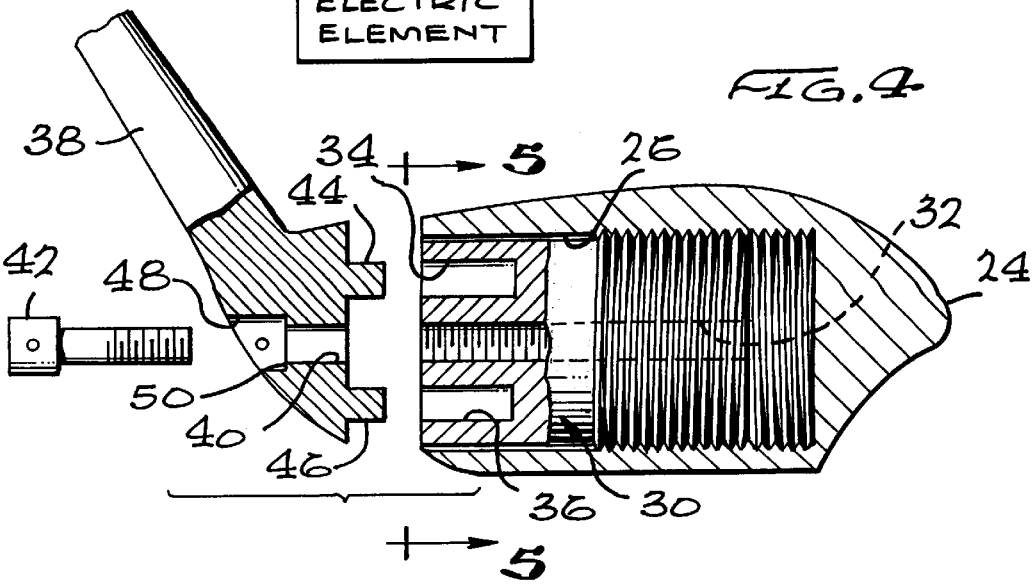

FIG. 5
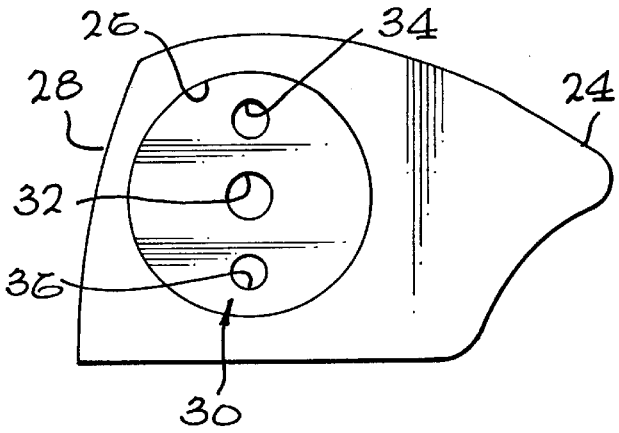
FIG. 11
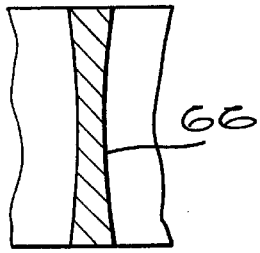
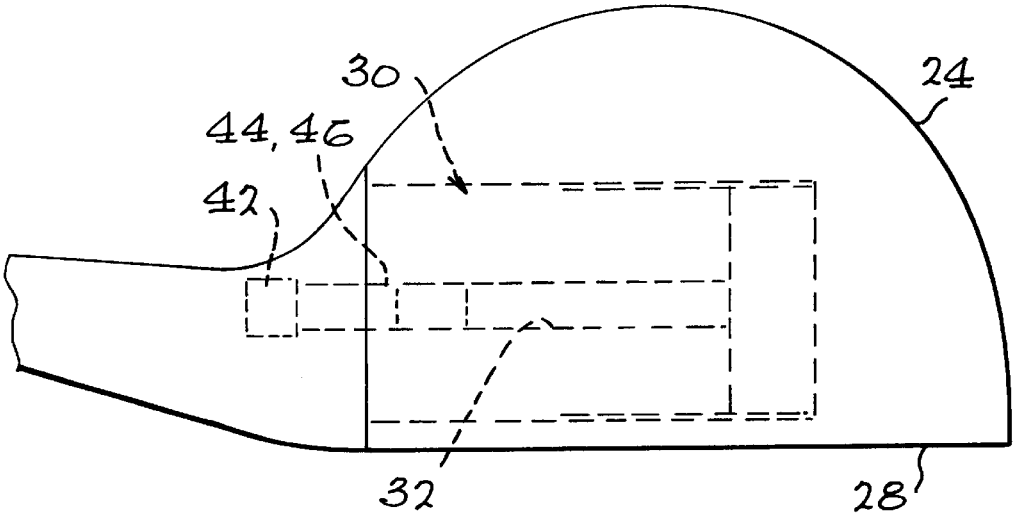
FIG. 7
FIG. 6
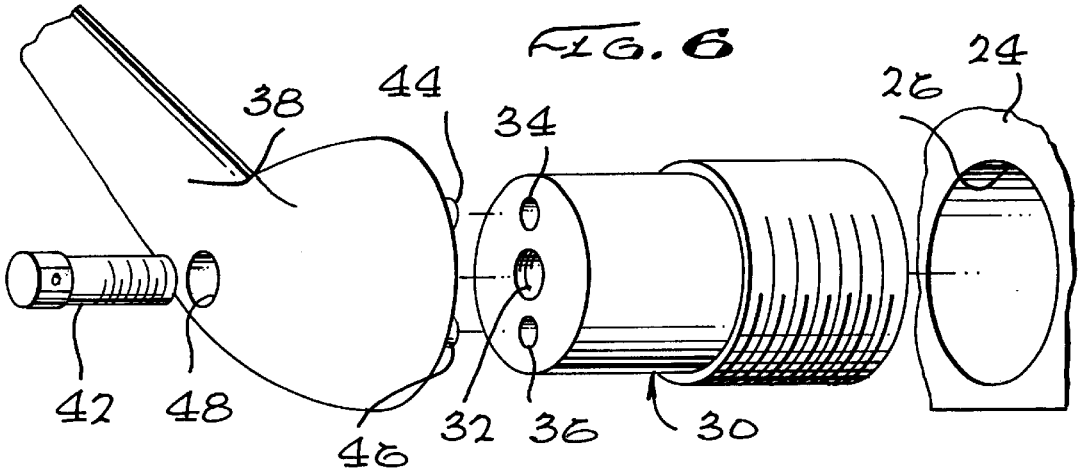

FIG. 8
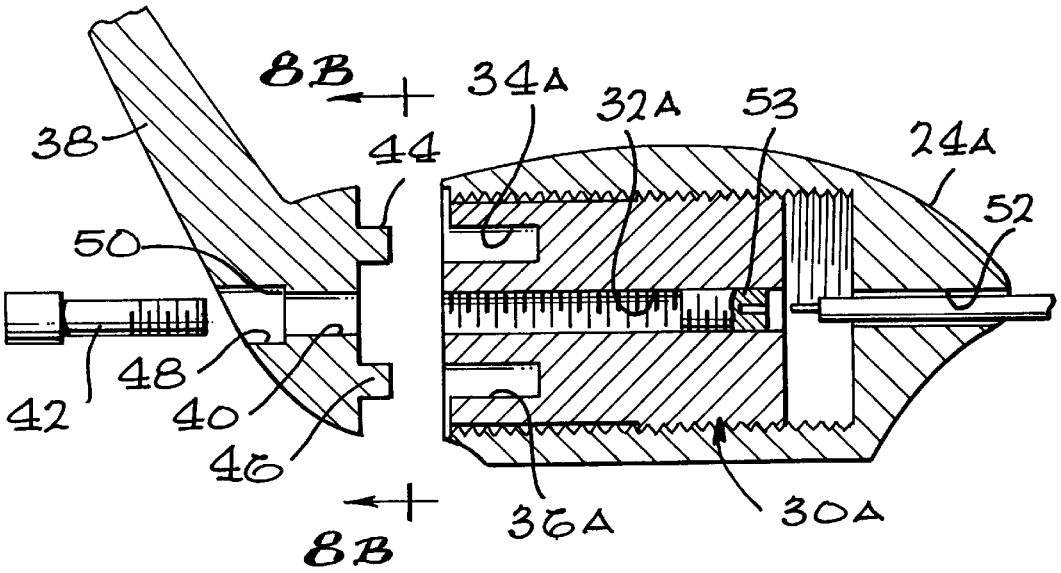
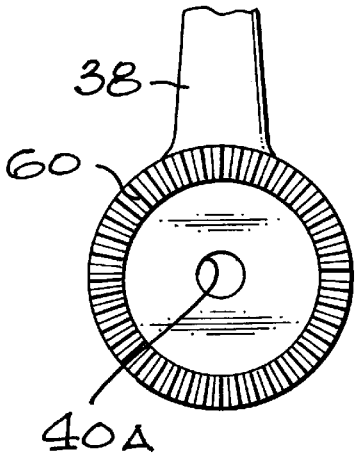
FIG. 8B
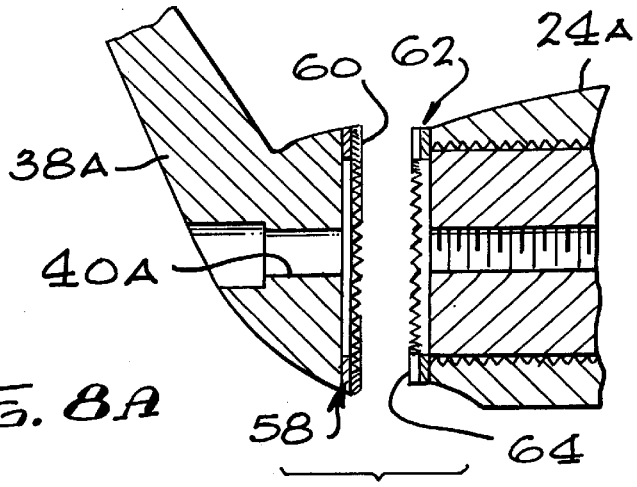
FIG. 8A

FIG. 8C
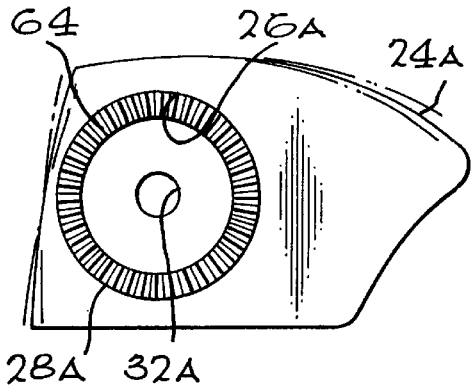
FIG. 9
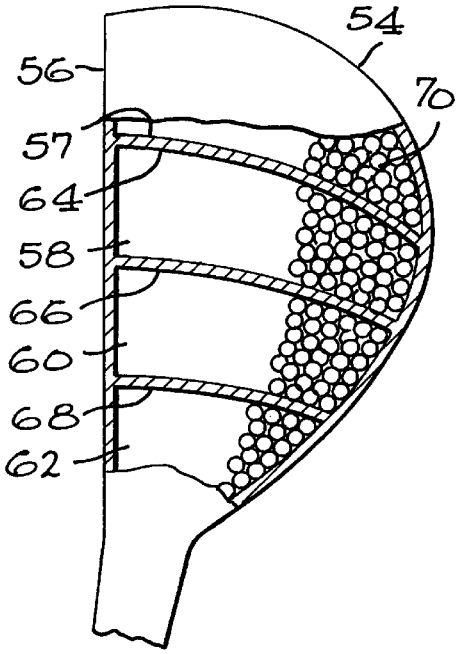
FIG. 9A
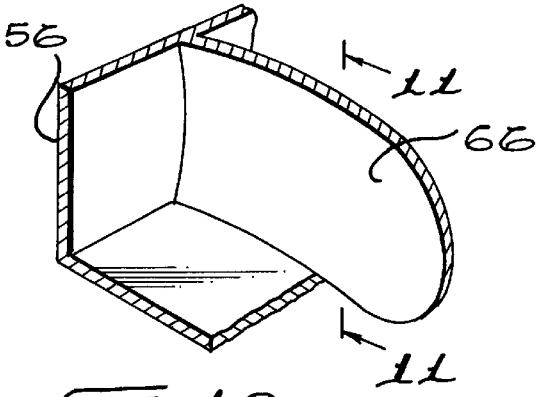
FIG. 10
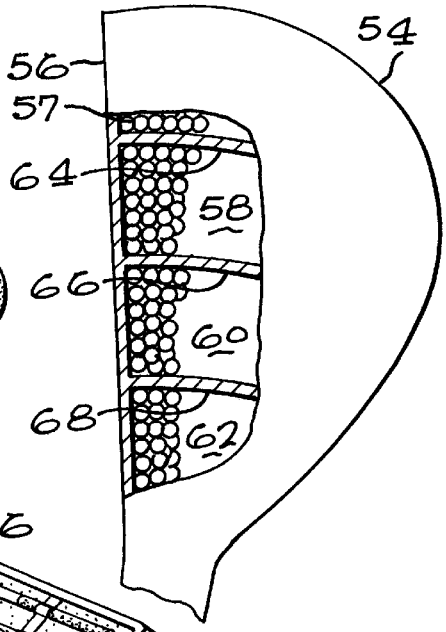
FIG. 9B
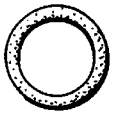
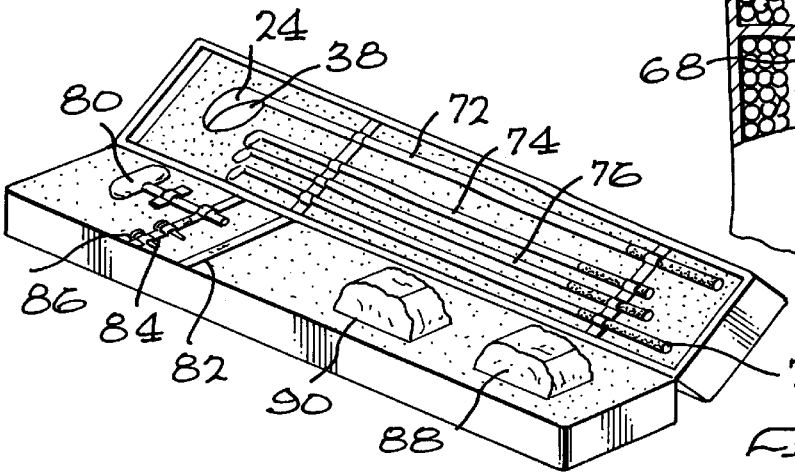
FIG. 12

122
124
120
114
110
106
108
112
104
100
102
130

104
132
100
130

110
114
118
116

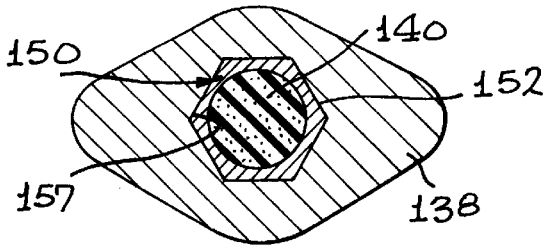
FIG. 23
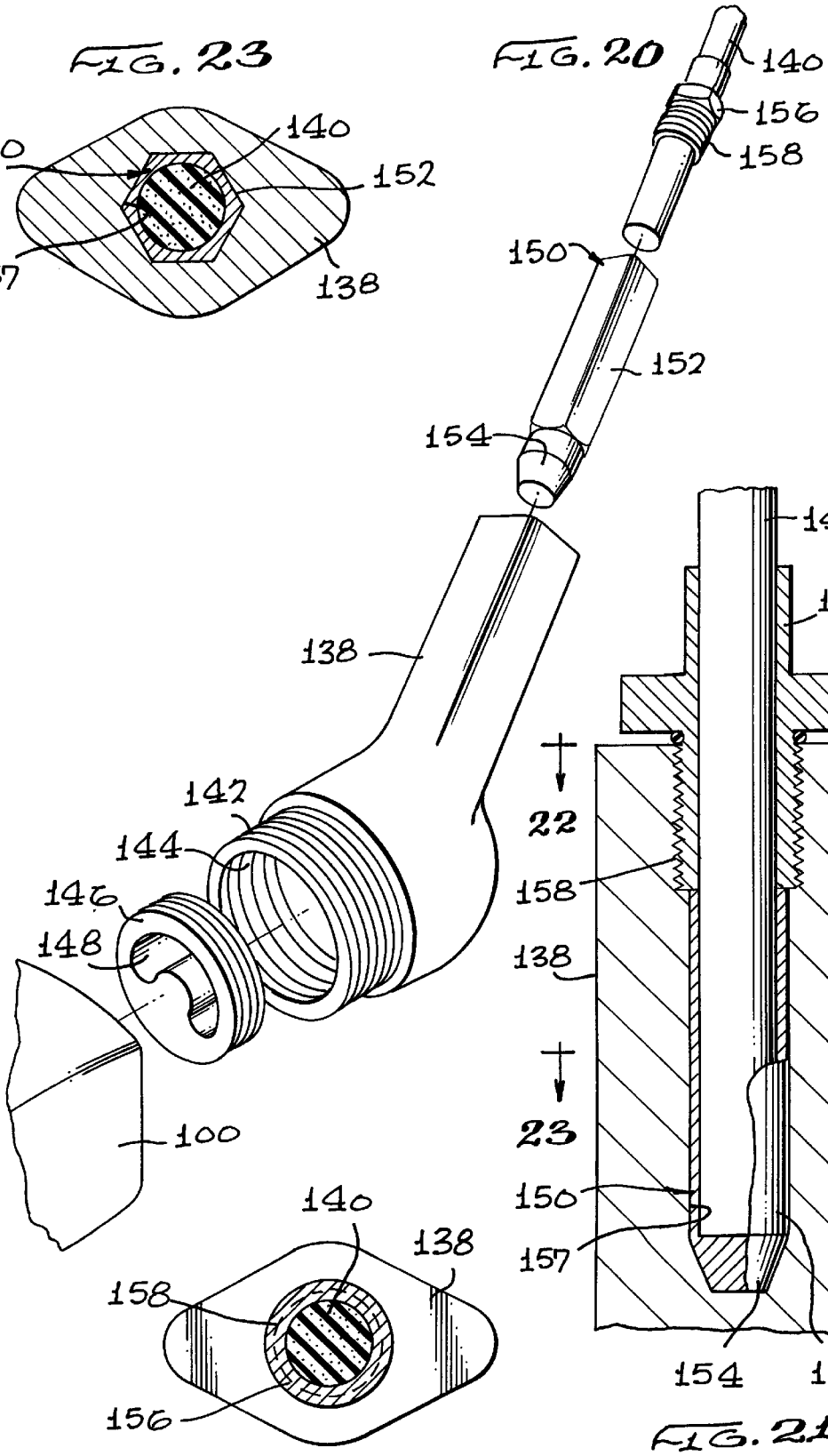
FIG. 20
FIG. 21
FIG. 22

FIG. 25
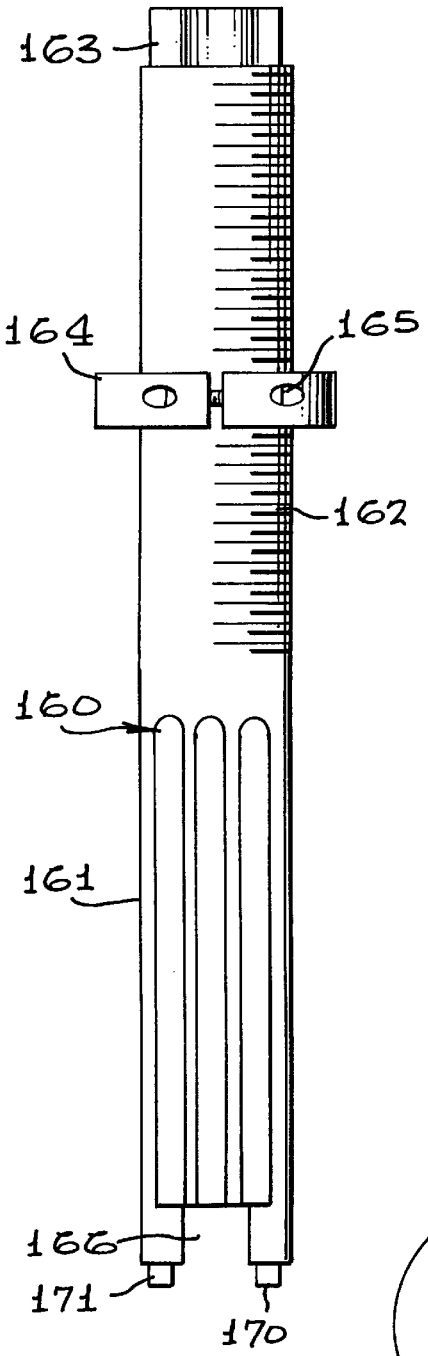
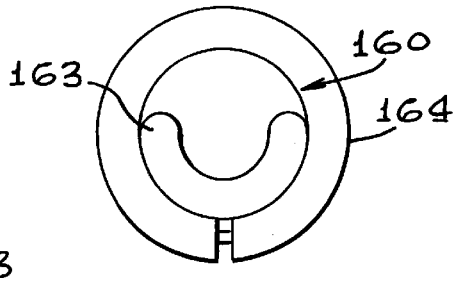
FIG. 27
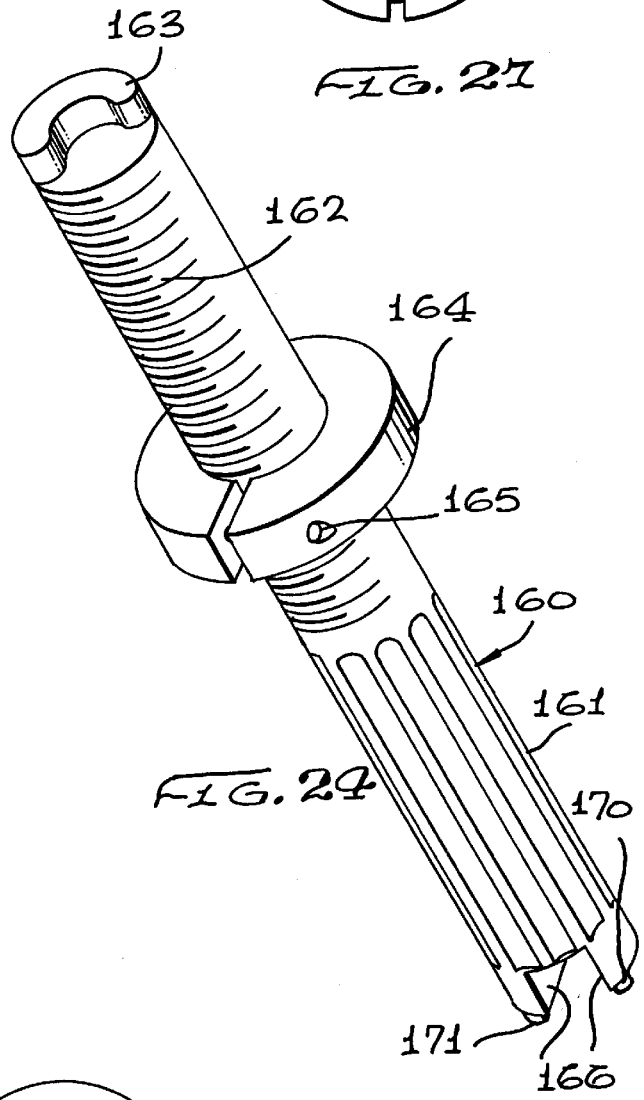
FIG. 24
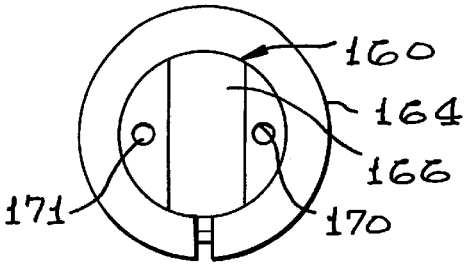
FIG. 26

GOLF CLUB

REFERENCE TO RELATED APPLICATION(S)

This application claims benefit of U.S. Provisional Application Ser. No. 60/025,236 filed Sep. 13, 1996.

BRIEF SUMMARY OF THE INVENTION

In recent years there has been a tremendous resurgence of interest in the game of golf. This has been accompanied by a number of new designs of golf clubs all promising to lengthen drive, increase accuracy and turn duffers into professional quality players. Many of these promises have gone unfulfilled so the search continues for improved concepts which really perform.

I have been involved in the design of mechanical systems in which I have looked to basic fundamentals which often results in simplification yet improved performance. I can see that many of the attempts to design improved golf clubs may have merit but it is my belief that some simple fundamental changes can produce a significantly better performing golf club.

There have been many attempts to enlarge the sweet spot of a clubhead. This has been done by enlarging the head in its entirety and in certain cases by distributing the volume of material to the edges of the clubhead. These attempts are designed to enlarge the sweet spot or more precisely to allow a slightly miss hit ball to have less effect upon the transfer of energy from the clubhead to the ball and to prevent twisting of the club in the hands of the golfer upon impact resulting in a hook or slice.

There is also an interest in avoiding twisting of the club in the hands of the golfer from too light a hold on the grip of the golf club. Yet an excessively tight hold will result in tensing of arm muscles resulting in loss of control of the golf swing.

With the foregoing state of the art, I have recognized that different approaches can fill the need for enlarged sweet spot or improved performance in general.

Specifically, in one embodiment of my invention, I employ a hollow clubhead which has a plurality of individual chambers extending from the club face rearward through its body. Contained within each chamber are movable mass members which move subject to the force of the swing and the force upon impact with the ball. The force acting on the mass members during swing is principally centrifugal force and the force upon impact tends to drive the mass members into contact with the inside of the club face to transfer their kinetic energy to the club face at and shortly after the impact with the golf ball providing additional energy as well as absorbing undesirable vibrations. I have determined that it is desirable that the internal walls defining each one of the chambers be curved to conform with the arc of the swing.

I have also discovered that in connection with the movable weight within the club head that it is possible using an eccentric weight member of uniform, preferably threaded, exterior that the center of gravity of the weight and of the entire club head may be shifted to higher or lower positions in the head and actually farther forward or toward the rear of the club head.

In another embodiment of my invention, the clubhead is separable from the hosel and is adjustable in the angle of the head face. It also allows for the adjustment of a movable mass member located behind the face of the club which concentrates the force of the club and also enlarges the "sweet spot" for greater accuracy. The mass member is preferably an aluminum cylindrical weight threaded into the body of the club and movable longitudinally parallel to the face of the club. With the readily separable hosel and clubhead, it is easy to attach a different shaft and hosel to the clubhead.

Once the mass member is adjusted to the desired position, it is not normally readjusted as the club is in use.

A modification of the above embodiment incorporates an internally adjustable weight member which can be readily adjusted by a golfer to fine tune the weight distribution of his club serving as an anti hook or slice device.

In my analysis of this invention, I have also discovered that even in apparently identical shafts made by the same manufacturer, the wall thickness of hollow shafts very from as little as 0.004 in. to 0.014 in. at various positions around the shaft tube. This has a great effect on the stiffness and flexibility of the shaft. In other words, the shaft may respond quite differently depending on its orientation with respect to the face of the club. Therefore, I have provided a shaft attachment feature which allows a selection of angular orientation of the shaft head positions.

In order for the shaft to be properly attached to the head and for the weight positioning as is described herein within the head, I have produced a novel adjusting and locking tool which is also disclosed and claimed.

As a result of the development of the foregoing embodiments, the system of this invention provides:

a. Interchangeable/quick detachable shafts;

b. Totally adjustable center of gravity;

c. Full range of adjustable loft;

d. Adjustable lie; and e. Open or closed face adjustment options.

Additionally, for the manufacture it provides:

a. Cost effective manufacturing;

b. Major reduction in inventory including the same head for right or left handed players;

c. Additional multiple shaft sales;

d. Additional retrofitting after initial sale;

e. A precise custom fitting tool; and f. Most technologically advanced golf club offered.

For the user, it also provides:

a. Custom fitting to give greater distance, accuracy, control and consistency;

b. A secure investment as the system can be reprogrammed as a golfer's level of skill changes;

c. Positive alternatives for the physically challenged; and d. Allows simple change of shaft by the user himself.

BRIEF DESCRIPTION OF THE DRAWING(S)

This invention may be more clearly understood with the following detailed description and by reference to the drawings in which:

FIG. 1 is a perspective view of a golf club incorporating one or more embodiments of my invention;

FIG. 2 is a sectional view through the handle of the golf club of FIG. 1;

FIG. 3 is a front elevational view, partly in section showing internal structure of FIG. 2 on an enlarged scale;

FIG. 3A is a block diagram of the device of FIGS. 1–3;

FIG. 4 is a sectional drawing of a golf clubhead and hosel incorporating another embodiment of my invention;

FIG. 5 is a view taken along line 5—5 of FIG. 4;

FIG. 6 is an exploded view of a portion of the structure of FIGS. 4 and 5;

FIG. 7 is a top view of the golf clubhead and hosel of FIGS. 4–6 with internal parts shown in dashed lines;

FIG. 8 is a sectional view of a golf clubhead constituting a modification of the golf clubhead of FIG. 4;

FIG. 8A is a fragmentary view of a portion of a clubhead and hosel similar to FIG. 8 showing a modification thereof;

FIG. 8B is an end view of the hosel of FIG. 8A;

FIG. 8C is an end view of the clubhead of FIG. 8A showing how the angle of the clubhead may be varied;

FIG. 9 is a top view, partly broken away, of a golf clubhead incorporating a third embodiment of my invention having internal movable mass members;

FIG. 9A is a view similar to FIG. 9 but in which the mass members are moved toward the face of the club;

FIG. 9B is an enlarged plan view of a typical rubber O-ring which may be used as a mass member in the embodiment of FIGS. 9 and 9A;

FIG. 10 is a fragmentary view of a portion of the golf clubhead of FIGS. 9 and 9A;

FIG. 11 is a sectional view taken along line 11—11 of FIG. 10;

FIG. 12 is a perspective view showing the packaging of a golf club as shown in FIGS. 4–8C;

FIG. 20 is an exploded view of an alternate hosel and removable shaft usable with the golf club of FIGS. 13–19;

FIG. 21 is a fragmentary cross sectional view of the shaft and hosel of FIG. 20;

FIG. 22 is a cross sectional view taken along line 22—22 of FIG. 21;

FIG. 23 is a cross sectional view taken along line 23—23 of FIG. 21;

FIG. 24 is a perspective view of an adjusting and locking tool for the golf club of this invention;

FIG. 25 is a front elevational view thereof;

FIG. 26 is a front end elevational view thereof; and

FIG. 27 is a rear end elevational view thereof.

DETAILED DESCRIPTION

Figures 13, 14, 15:
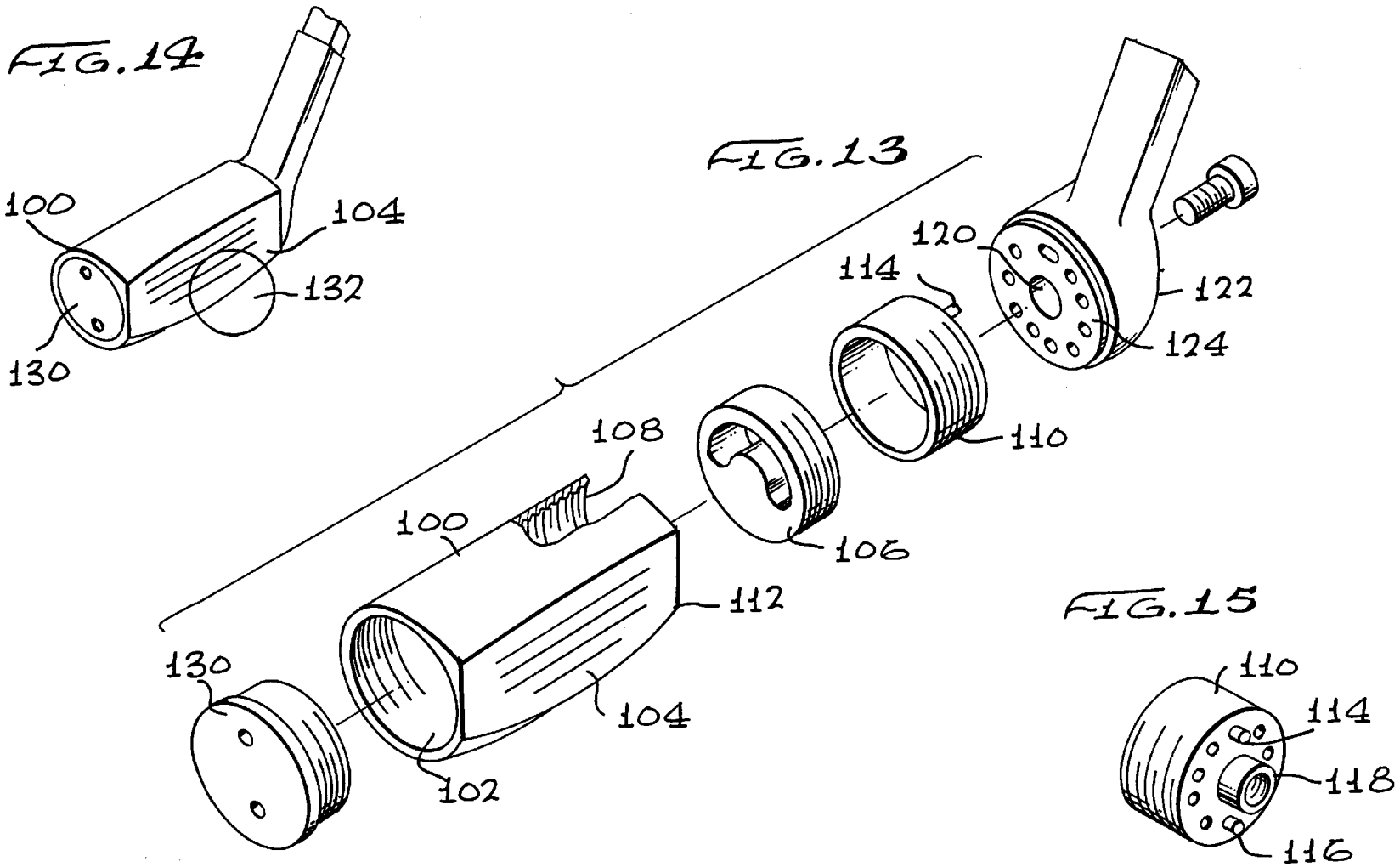
FIG. 13 is an exploded view of another embodiment of my invention.
FIG. 14 is a view of the assembled clubhead and hosel of FIG. 13.
FIG. 15 is a perspective view from the opposite side of the cylindrical member mating with the hosel of FIG. 13.

It is recognized that a consistent grip is a significant part of a good golf swing. If the grip is too loose, the club may twist in the golfer's hand upon impact with the ball resulting in badly hit drives. If the grip is too tight, there is an excessive tensing of many muscles of the upper body which frequently results in "topping" the ball or hitting it in a wrong direction. The device of FIGS. 1–3A will notify a player, either visibly or audibly, if he or she is applying the same amount of grip pressure each time he or she is swinging the golf club.

FIG. 1 shows a typical golf club 10 of the type referred to as a "wood" but which is often made of metal. FIG. 2 illustrates the grip 12 of the golf club of FIG. 1.

Applicant has determined that a piezoelectric device 14 may be incorporated into the rubber grip 12 of the club 10. The piezoelectric device 14 is a planar sheet attached to a cylindrical member located within the handle 12 such that when a player grips the rubber handle a squeezing force is applied to piezoelectric device 14 causing it to generate a small electrical voltage. The harder the piezoelectric device 14 is squeezed, the higher its voltage output. This voltage output is supplied to a small circuit board 16 which converts the voltage to a measured output which, at a particular voltage level, will illuminate a LED (light emitting diode) 18 or actuate a small sound transducer to make an audible sound when the grip is recognized as being at a desired level. Connected into the circuit board 16 is a small rheostat or rotary switch (not shown) to set the level of pressure sensitivity to suit the personal requirements of each individual. With this device an individual can set the rheostat to a desired level and then can learn to be more consistent with their grip on the club handle 12, by increasing their grip each time just until the LED is illuminated or the audible output occurs. If desired, a second LED 20 of a contrasting color may be wired into the circuit 16 which is responsive to an excessive grip pressure. Commercially available piezoelectric devices and circuits are available as follows:

AMP Inc., P.O. Box 799, Valley Forge, Pa. 19482.

FIG. 3A is a block diagram indicating the electrical connections and elements of the structure of FIGS. 2 and 3. The piezoelectric element 14 responds to a grip on the handle 12 by generating a voltage which is supplied to the circuit board 16. Circuit board 16 includes a rheostat which sets a threshold and a comparison circuit which compares the generated voltage against the threshold value. If the threshold voltage is exceeded, the LED 20 will be illuminated, or an acoustic device will emit a sound.

FIG. 4 is a sectional view through a golf clubhead 24 incorporating another embodiment of my invention and FIG. 5 is a view taken along line 5—5 of FIG. 4. In FIGS. 4 and 5 golf clubhead 24 is shown with a relatively large cylindrical chamber 26 located just inside the club face 28 (FIG. 5). To provide a means for effecting an optimum balance of the clubhead, chamber 26 includes fine inside threads engaged with threads on a cylindrical weight member 30 which preferably would weigh about 6½ to 7½ oz. Member 30 also includes a threaded bore 32 along its axis and a pair of radially displaced bores 34 and 36.

A hosel 38 includes a bore 40 designed to receive a bolt 42 which engages the threads of bore 32 to secure the hosel 38 to weight 30. Hosel 38 also includes a pair of pegs 44 and 46 which align with bores 34 and 36 to prevent radial displacement of the cylindrical weight member 30 relative to the hosel 38. A counterbore 48 concentric with bore 40 permits the bolt 42 to be turned into threaded bore 32 until its head contacts a shoulder 50 of hosel 38.

A golfer using this club may experimentally determine the axial position of weight member 30 which appears to provide the best balance and least tendency for twisting and producing hooked or sliced drives. A tendency to hook the ball, for example, would indicate the weight member 30 is too far out on the toe of the clubhead 24 and, with bolt 42 disengaged from bore 32, weight member 30 may be turned within chamber 26 to thereby move weight member 30 axially inwardly or away from the toe of clubhead 24. Consistent slices would indicate member 18 is too far inward and should be moved outwardly toward the toe of clubhead 24. The angle of the clubhead 24 can be varied by turning the head on the threads of weight member 30 with bolt 42 loose or disengaged from bore 32. Once the position is established for weight member 30 and the clubhead angle established, members 30 and 24 are cemented or otherwise fastened together so that clubhead 24 will not rotate on impact with a ball. A single clubhead may in this manner be used to provide a driver or any of the other fairway woods. This flexibility can substantially reduce the inventory of clubs carried by a store, pro shop or manufacturer.

FIG. 6 is an exploded view of the structure of FIG. 4 and 5. In this view weight member 30 is shown axially aligned with chamber 26 and bolt 42 aligned with bore 40 and counterbore 48 of hosel 38. Also shown are bores 34 and 36 of weight member 30 but mating pegs 44 and 46 are not visible in this view.

FIG. 7 is a top view of clubhead 24 showing face 28 and hosel 38. Shown in dotted outline are internal parts including weight member 30 in chamber 26, bolt 42 in bore 32 and peg 44.

FIG. 8 is a view of a clubhead 24A similar to FIG. 4 but modified to permit a golfer to fine tune the weight distribution of head 24A. In this view, parts which are, or may be, the same as the parts of the embodiment of FIGS. 4–8 are given the same numerals. Thus hosel 38 includes a bore 40 and pegs 44 and 46 which align with bores 34A and 36A to prevent radial displacement of cylindrical weight member 30A relative to the hosel 38. Cylindrical weight member 30A includes an axial bore 32A which receives a bolt 42 to be turned into threaded bore 32A until its head contacts shoulder 50. The head 24A is secured to weight member 30A by means of fine threads as described above, which threads make it possible to adjust the weight distribution of the clubhead and to vary the loft of the face of the clubhead 24A. Once the position of weight member 30A is established, it is cemented or otherwise secured to clubhead 24A as described above. Also formed in clubhead 24A is a bore 52 in the outboard end of clubhead 24A which is aligned with bore 32A. A separate counterweight member 53 which may be of about 14 grams is threadedly engaged with threads in bore 32A and is accessible through bore 53 by means of an Allen wrench or other suitable means to turn counterweight 54 to move it axially in bore 32A. In this manner a golfer can fine tune the weight distribution of his club.

Should it be desired to make the club adjustable for loft or club face angle on a continuing basis, the opposing faces of a hosel 38A and clubhead 24A may be formed with mating serrations 60 on hosel 38A and 64 on clubhead 64A as shown in FIG. 8A. By loosening bolt 42, the clubhead 24A may be rotated a small amount relative to hosel 38A after which the bolt 42 is tightened, pressing the serrated surfaces 60 and 64 together and preventing any rotation of the clubhead 24A upon impact with a ball. The serrations may be formed integrally with hosel 38A and clubhead 24A or preferably, be formed on separate washer-like members 58 and 62 which are then cemented or otherwise secured to hosel 38A and clubhead 24A as shown on FIG. 8A. Other equivalent fastening means could be employed.

It is useful to place index marks on the top surfaces of the hosel 38A and the clubhead 24A so that the golfer will have a clear idea of how much loft he is selecting. A given club may be set up with an initial loft of 14° and be adjustable in 1° or 2° increments over a range of, for example, 8° to 20°.

FIG. 8B is a fragmentary end view of hosel 38A with serrated member 58 attached. The surface of member 62 attached to clubhead 24A would appear essentially identical as shown in FIG. 8C. With this described structure the clubhead may be rotated relative to the hosel as shown in FIG. 8C.

Shown in FIG. 9 is a third embodiment of my invention including a golf clubhead shown at numeral 54 including a face 56 and a plurality of internal chambers 57, 58, 60 and 62. Separating chambers 56–62 are a plurality (in this case 3) of curved parallel walls 64, 66 and 68 which at their point of connection are perpendicular to face 56. Positioned in chambers 56–62 are movable mass members 70. Preferably, the end surfaces of chambers 57 and 62 are also parallel to the surfaces of walls 64, 66 and 68 and also are contoured with concave radii the same as walls 64, 66 and 68 as shown in FIG. 11. The mass members 70 may be rubber O-rings as shown (greatly enlarged) in FIG. 9B, ceramics, or carbongraphics, to achieve a desired mass. A preferred overall head 54 weight is in the range of 7½ oz. to 10 oz. of which 14 to 50 grams are movable mass members 70.

When the golfer swings the club toward the ball the mass members 70 will tend to accumulate toward the rear of the clubhead and will be held there by centrifugal force. Upon impact with the ball, mass members 70 will almost instantly move against the inside of the club face 56 to transfer their kinetic energy to the ball as shown in FIG. 9A.

FIG. 10 is a perspective view of a broken away portion of clubhead 54 showing a portion of the inside of face 56 and one of the parallel walls (in this case, wall 66) adjoining face 56. FIG. 11 is a sectional drawing taken along line 11—11 of FIG. 10 and shows that the wall 66 is concave on both sides. Walls 64 and 68 have the same contour as wall 66 as do the parallel end walls of chambers 57 and 62. The principles of this concept could as well be applied to other sporting goods such as softball or baseball bats.

FIG. 12 is a perspective drawing of a packaged set of golf clubs made according to the embodiments of FIG. 4–8. Since the clubhead 24 may be adjusted to provide a range of angles of lift from that of a driver (10°) to at least that of a No. 4 wood which would be about 17–20°, only one clubhead is required for an entire set of woods. This clubhead may be placed on shafts of different lengths as desired. The handle length of a No. 4 wood is, of course, significantly shorter than that of a driver. The kit 71, includes, therefore, handles and shafts 72, 74, 76 and 78 all of which attach to head 24 since they all have hosels identical to hosel 38. Also included is a tool 80 for removing and replacing bolt 42. Bands 82 and 84 secure tool 80 as well as some tees 86. Pouches 88 and 90 are included for storage of golf balls or other items.

FIG. 13 is an exploded view of an additional embodiment of my invention. A clubhead 100 includes a large diameter threaded passageway 102 extending through its entire length and parallel to the club face 104. A weight member 106 is threadedly engaged with the threads 108 in passageway 102 and is movable along the passageway to adjust the weight balance of the club. A weight and attachment member 110 is also threadedly engaged with the threads 108 in passageway 102 and is turned into passageway 102 until it is approximately flush with the end 112 of clubhead 100. Member 110 whose opposite end is shown in FIG. 15 includes a series of circumferential ports radially outwardly displaced from its axis. A pair of pins 114, 116 are placed in two of the ports approximately 180 degrees apart. Member 110 also includes a collar portion 118 extending outwardly along its axis which is internally threaded and which fits into an opening 120 in a hosel 122. The face 124 of hosel 122 includes a series of circumferential ports spaced radially outwardly from an opening 120, one of which 126 is slotted or elongated. A bolt 128 passing through hosel 122 secures hosel 122 to member 110. At the opposite end of clubhead 100 is a cylindrical plug 130 which is threadedly engaged with threads 108 to close the end of the clubhead. Plug 130 includes an axial port 131 which provides access for a tool to engage a projection 107 on weight member 106 to move it axially. Projection 107 has a rectangular cross section as shown in FIG. 13. Plug 130 also includes a pair of spaced bores 133 which receive a tool for turning plug 130 in threads 108.

FIG. 14 shows the golf club of FIG. 13 as assembled with the hosel 122 secured to one end of the clubhead (actually to member 110, not shown) and with plug 130 closing the opposite end. A golf ball 132 is shown in phantom adjacent face 104.

Figures 16, 17, 18, 19:
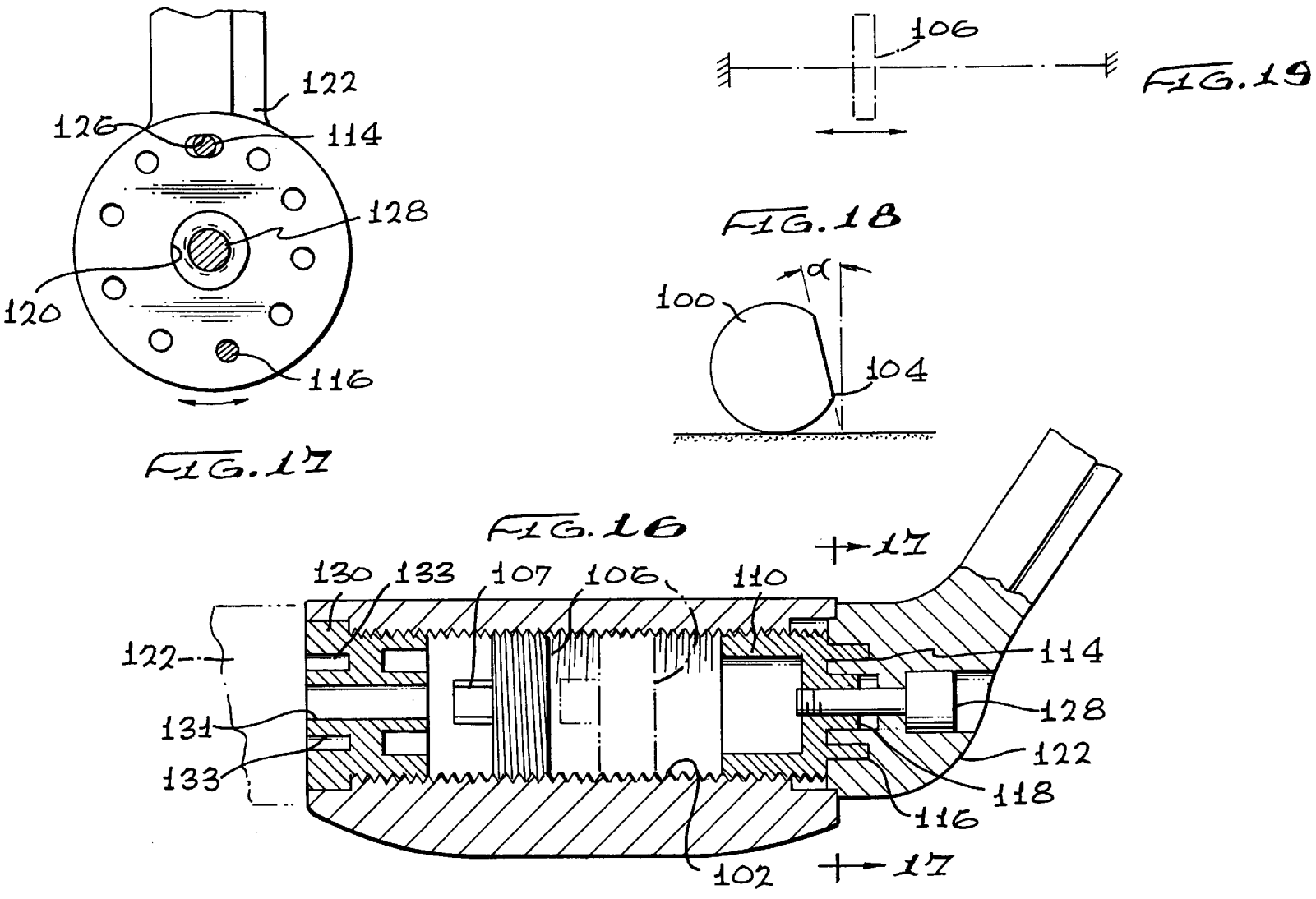
FIG. 16 is a sectional view taken through the clubhead and hosel of FIG. 14.
FIG. 17 is a fragmentary elevational view of the face of the hosel of FIG. 13.
FIG. 18 is a diagrammatic view of the end of the clubhead showing the variation in loft or club face angle made possible with the hosel/clubhead design of FIGS. 13, 14 and 15.
FIG. 19 is a diagrammatic view showing how the internal weight member of FIG. 13 is movable parallel to the face of the club to adjust the weight balance of the club.

FIG. 16 is a sectional view through the clubhead 100 and hosel 122 as assembled. As indicated in phantom, weight 106 is movable along passageway 102 as desired to achieve the desired weight balance of clubhead 100. Pins 114 and 116 are positioned in corresponding ports in hosel 122, one of which is slotted port 126. Also shown in phantom at the left end of clubhead 100 is an alternate position for hosel 122, since clubhead 100 is symmetrical and may be assembled either right or left handed.

FIG. 17 is a fragmentary elevational view showing the face of hosel 122 with opening 120 and bolt 128 shown in section. The series of ten circumferential ports are shown including the slotted port 126 which is shown containing pin 114 and anther port containing pin 116. By judicious placement of pins 114 and 116, any degree of loft of clubhead 100 may be provided within the normal range of loft from a driver to a number 4 wood. This is indicated in FIG. 18 wherein the diagram indicates that the clubhead 100 may be rotated to vary the angle of its face 104 by an angle alpha. In my preferred embodiment, pin 114 is fixed to member 110 and of larger diameter and pin 116 is removable and may be located in any of the available openings in the fact of the hosel 122. In any case, the bolt 128 secures the head at the desired loft. This change of loft can be made by a player during play if desired but the preferred arrangement is that the weighted loft and shaft orientation can be adjusted by a professional golfer to meet the best arrangement for the player and all cemented in place.

FIG. 19 is a diagram showing the manner in which the weight 106 may be moved along the axis of clubhead 100 to shift the weight balance as desired.

FIG. 20 is an exploded view of a modified hosel 138 which receives a removable shaft 140. Hosel 138 includes external threads 142 which engage threads 108 of clubhead 100 and also internal threads 144 which receive a weight member 146. Weight member 146 includes a "C" shaped cut-out 148 which mates with a special tool, described above, to turn member 146 within the threads 144. Since cut-out 148 is concentrated on one side of member 146, turning of member 146 effects a significant modification in the weight balance near the heel of the face of the club. The weight member has its center of gravity displaced from the axis of rotation.

Shaft 140 is received in a hollow generally cylindrical fitting 150 which has a hexagonal surface 152 over part of its length and a tapered lower end 154 which fits into a socket in hosel 138. Axially movable on shaft 140 is a threaded cylindrical ferrule 156 which has threads 158 engaged with threads on the upper part of hosel 138. This structure is shown on FIG. 21 wherein fitting 156 is shown seated in a socket 157 in hosel 138. The internal bore in hosel 138 also has a hexagonal cross-section to receive fitting 150. In this view ferrule 156 has been moved down the shaft 140 and threads 158 are engaged with internal threads in the top of hosel 138. With the arrangement shown it is apparent that shaft 140 is readily removed and replaced with a longer or shorter shaft as desired.

FIG. 22 is a cross-sectional view taken along line 22—22 of FIG. 21. On this view it is seen that the threads 158 of ferrule 156 are engaged with those on hosel 138 with shaft 140 passing through the center.

FIG. 23 is a cross sectional view taken along line 23—23 of FIG. 21. This view shows the fitting 150 with its hexagonal sides which mate with the hexagonal bore in hosel 138.

In order to achieve the maximum value of my invention I have discovered a real need for an adjusting and locking tool which is designed to make precise adjustments in the location of the weight within the club head and to attach, adjust and remove the shaft from the club head and to open and close the club head to allow the adjustments in longitudinal weight balance.

Referring now to FIG. 24 in combination with FIGS. 25 and 27, an adjusting and locking tool 160 may be seen. The tool 160 includes a handle portion 161 and at its front end, a threaded section 162 which terminates in an arcuate working tool end 163 shaped to match with the arcuate opening 148 in the weight 146 of FIG. 20.

An internally threaded locking ring 164 includes a locking screw 165 to hold the locking ring 164 at any longitudinal position along the length of the threaded portion 162.

At the opposite end of the tool 160 from its operating heads 163 is a slotted wrench portion 166. Barely showing in FIG. 24 are a pair of spanner wrench pins 170 and 171 which are used to remove the plug 130 of FIG. 17.

The slot 166 is dimensioned to engage the threaded ferrule 156 of FIG. 20 for loosening and tightening ferrule 156 when attaching or adjusting the club shaft 140.

From the foregoing it will be appreciated that the golf club according to the present invention is extremely flexible and can be made to suit a large number of players, both right or left handed. This can significantly reduce the inventory of a professional golfer's shop. A desirable weight balance can be determined by proper positioning of the adjustable weights as described. The loft is also adjustable, as described. Once the desired position of the various parts in the clubhead and between the clubhead and the hosel are determined, the parts are secured together as by an epoxy cement which makes the assembly solid and not further adjustable. Since clubhead 100 is threadedly engaged with hosel 138, the loft is determined by turning the clubhead to the desired angle after which the assembly is cemented together.

The above described embodiments of the present invention are merely descriptive of its principles and are not to be considered limiting. The scope of the present invention instead shall be determined from the scope of the following claims including their equivalents.

What is claimed is:

1. A golf club including a shaft, a grip on the shaft, a head and a hosel attaching said head to said shaft;

said head including a ball striking surface, a cylindrical chamber having a first end and a second end and whose axis is substantially parallel to said striking surfaces, internal threads in said chamber and a side wall, a weight member threadably engaged with the threads in said chamber and movable axially in said chamber;

said head including an opening in said chamber for access to said weight member, said weight member being accessible through said opening to adjust the position of said weight member; and means for closing said opening.

2. A golf club in accordance with claim 1 wherein said closing means comprises a hosel of the golf club.

3. A golf club in accordance with claim 1 including means for securing the longitudinal position of the weight member within the chamber.

4. A golf club in accordance with claim 1 wherein one end wall of said chamber is defined by an end of said hosel.

5. A golf club in accordance with claim 1 wherein one wall of said chamber is defined by a removable plug.

6. A golf club in accordance with claim 1 wherein said weight member has a center of gravity offset from its axis of rotation whereby upon rotation of the weight member about its axis of rotation, the center of gravity of the weight member is moved thereby moving the center of gravity of the club head.

7. A golf club including a shaft, a grip on said shaft, a head and a hosel attaching said head to said shaft;

said head including a ball striking surface, a cylindrical chamber having a first end and a second end and whose axis is substantially parallel to said striking surface, internal threads in said chamber side wall, and a weight member threadedly engaged with the threads in said chamber and movable axially in said chamber;

said head including an opening in said chamber for access to said weight member, said weight member being accessible through said opening to adjust the position of said weight member;

means including said hosel for closing said opening; and means for securing said weight in the chamber including threads on the exterior of said weight member engaging mating threads in said chamber.

8. A golf club in accordance with claim 7 wherein said securing means includes means bonding said weight member to at least one wall of said chamber.

9. A golf club in accordance with claim 7 wherein said hosel includes a plurality of angularly selectably securing means for engagement with said club head and said club head includes mating securing means of adjustably changing the loft for the golf club.

10. A golf club in accordance with claim 9 wherein said securing means and mating securing means comprises a plurality of angularly displaced pins and mating recesses.

11. A golf club including a shaft, a grip on the shaft, a head and a hosel attaching said head to said shaft;

said head including a ball striking surface, a cylindrical chamber whose axis is substantially parallel to said striking surface and threads in said chamber, a generally cylindrical weight member threadedly engaged with the threads in said chamber and movable axially in said chamber, said weight member also having a threaded bore along its axis;

said hosel including a bore in alignment with said threaded bore and a bolt passing through said bore and threadedly engaged with said threaded bore and means operable between said weight member and said hosel for establishing radial alignment of said head and said hosel.

12. A golf club as claimed in claim 11 wherein said cylindrical chamber extends through the length of said head, and an axially movable weight is threadedly engaged with the threads in said chamber.

13. A golf club as claimed in claim 11 wherein said cylindrical chamber extends entirely through said head such that said generally cylindrical weight member can be installed in either end of said cylindrical chamber.

14. A golf club as claimed in claim 11 wherein said hosel includes a circular contact face for contacting an end of said cylindrical weight member and said face includes a plurality of bores generally parallel to and radially outward of said bolt.

15. A golf club as claimed in claim 11 wherein said cylindrical weight member is cemented to said head.

16. A golf club as claimed in claim 11 wherein said threaded bore extends through the length of said cylindrical weight member, an axially movable weight is threadedly engaged with said threaded bore and said head includes a bore aligned with said threaded bore for reception of a tool for turning said weight in said threaded bore to vary the position of said weight.

17. A golf club as claimed in claim 11 wherein said means for establishing radial alignment between said head and said hosel includes a large number of mating radially aligned teeth on said cylindrical weight member and said hosel.

18. A golf club as claimed in claim 11 wherein said means for establishing radial alignment between said head and said hosel includes at least one bore in one of said cylindrical weight members and said hosel parallel to and radially displaced from said threaded bore and a cylindrical projection on one of said hosel and said cylindrical weight member aligned with said radially displaced bore.

19. A golf club including a shaft, a grip on the shaft, a head and a hosel attaching said head to said shaft;

said head including a ball striking surface, a cylindrical chamber whose axis is substantially parallel to said striking surface and threads in said chamber, a generally cylindrical weight member including a threaded bore, said weight member being threadedly engaged with the threads in said chamber and movable axially in said chamber;

a closure for said cylindrical chamber including a bore in alignment with said threaded bore and a bolt passing through said bore and threadedly engaged with said threaded bore and means establishing radial alignment of said head and said hosel.

20. A golf club as claimed in claim 19 wherein said hosel includes said closure and a cylindrical extension threadedly engaged with said threads in said chamber.

21. A golf club as claimed in claim 19 wherein said cylindrical extension also has internal threads and an asymmetrical cylindrical weight member is threadedly engaged with said internal threads.

22. A golf club including a shaft, a grip, a hosel, and a club head which is detachable from the hosel and wherein the club head is hollow, includes a movable weight therein and is closed by a plug which threadably engages a longitudinal cavity at one end and the hosel is in threaded engagement with the opposite end of the cavity and in which the shaft is secured to the hosel by means of a threaded ferrule;

a tool including a handle and means for engaging said plug for removing the plug from the club head;

said tool including a shaped end into the cavity in the club head;

said tool including a pair of arms defining a wrench and a spanner wrench;

whereby said tool can remove and replace the shaft from the hosel and the plug from the club head and adjustably position in said weight within the club head.

23. The combination in accordance with claim 21 wherein said tool is elongated with the shaped end for engaging the movable weight within the club located at one end of the tool;

an adjustable stop threadably engages the threaded portion of the tool for longitudinal adjustment; and the wrench elements are located at the opposite of said elongated tool from said shaped end.

24. A golf club including a shaft, a head and a hosel attaching said head to said shaft;

said head including a ball striking surface, a cylindrical chamber having a first end and a second end and whose axis is substantially parallel to said striking surface, internal threads in said chamber, a side wall and a weight member threadedly engaged with the threads in said chamber and movable axially in said chamber;

said head including an opening in one end of said chamber for access to said weight member, said weight member being accessible through said opening to adjust the position of said weight member; and means including said hosel for closing said opening.

25. A golf club as claimed in claim 24 wherein a cylindrical plug is threadedly engaged with the threads in said chamber and said plug and said weight member are cemented to said head to provide a solidly fixed club head after adjustment.

* * * * *